US007350488B2

(12) United States Patent
Harbert

(10) Patent No.: US 7,350,488 B2
(45) Date of Patent: Apr. 1, 2008

(54) ROCKER ARM COVER

(76) Inventor: Richard H. Harbert, 6700 Waterton Cir., Mukilteo, WA (US) 98275-2774

( * ) Notice: Subject to any disclaimer, the term of this patent is extended or adjusted under 35 U.S.C. 154(b) by 0 days.

(21) Appl. No.: 11/336,710

(22) Filed: Jan. 20, 2006

(65) Prior Publication Data

US 2007/0169734 A1 Jul. 26, 2007

(51) Int. Cl.
*F01M 9/10* (2006.01)

(52) U.S. Cl. ..... 123/90.38; 123/198 E; 123/195 C; 123/635

(58) Field of Classification Search ..... 123/90.38, 123/198 E
See application file for complete search history.

(56) References Cited

U.S. PATENT DOCUMENTS 5,323,745 A * 6/1994 Sato et al. ..... 123/195 C
6,494,193 B2 * 12/2002 Weingaertner et al. ..... 123/647
6,622,711 B1 * 9/2003 Skinner et al. ..... 123/634

FOREIGN PATENT DOCUMENTS

EP 512357 A2 * 11/1992

* cited by examiner

*Primary Examiner*—Thomas Denion
*Assistant Examiner*—Kyle M. Riddle
(74) *Attorney, Agent, or Firm*—Innovation Law Group, Ltd.; Jacques M. Dulin, Esq.

(57) ABSTRACT

A rocker arm cover comprises a shell having an upper portion and a lower portion formed by inner and outer side walls and end walls contiguous therewith. A dividing wall is joined to the side walls and end walls to define an upper cavity in the upper portion of the rocker arm cover and to define a lower cavity in the lower part of the rocker arm cover. A lid is fitted to the upper portion of the rocker arm cover to provide an enclosed cavity for housing the plurality of ignition coils.

7 Claims, 4 Drawing Sheets

ROCKER ARM COVER

BACKGROUND

The present invention relates to automobile engine components, and more particularly, to a cover for rocker arms on an internal combustion engine.

Conventional after-market rocker arm covers comprise a cover having a single cavity that encloses the rocker arms. In later model engines, the rocker arms also have mounted thereon a plurality of ignition coils that correspond to each cylinder in the engine. For the typical V8 engine, two rocker arm covers are employed for each bank of cylinders. Each of these rocker arm covers carries four ignition coils for each of the four cylinders in each cylinder bank.

The need for a cleaner, tidier rocker arm and coil arrangement has been extant for some time. However, the solutions therefor have been less than satisfactory.

SUMMARY

In one embodiment, the present invention provides a rocker arm cover that has a first cavity for enclosing the rocker arms and a second enclosed cavity for the ignition coils. The rocker arm cover comprises a shell having an upper portion and a lower portion defined by inner and outer side walls that are joined by end walls contiguous therewith. A dividing wall joins the interior of the side walls and end walls between the upper and lower portions. The dividing wall and the lower portion of the end and side walls define a cavity for enclosing the rocker arms of an internal combustion engine. The upper portion of the side walls and end walls and the dividing wall form an upper cavity for housing the ignition coils. A removable lid covers the upper portion to enclose the upper cavity and thus hide the ignition coils from view.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 12:
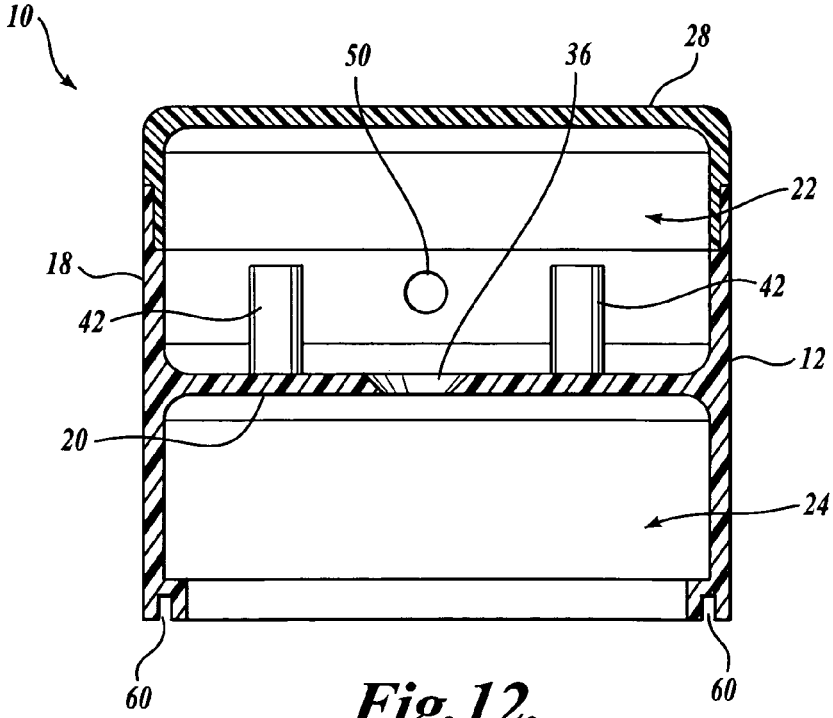
FIG. 12 is a cross-sectional view through the central portion of the rocker arm cover taken along section line 12-12 of FIG. 1.

Referring simultaneously to FIGS. 1-12, the rocker arm cover 10 includes a shell having upright side walls and end walls. An inner side wall 12 has its ends joined to end walls 14 and 16. The end walls are semi-circular and wrap around and are joined to a generally planar outside wall 18. A dividing wall 20 joins the interior surfaces of the side walls 12 and 18 and end walls 14 and 16 to form a lower cavity 22 and an upper cavity 24 (FIG. 12). The side walls and end walls are generally upright while the dividing wall 20 is generally horizontal. The dividing wall in its preferred embodiment lies in a plane perpendicular to the side and end walls. The bottom edges of the side walls and end walls are spaced equidistantly from the dividing wall 20. Similarly, the upper edges of the end walls and side walls are spaced equidistantly from the upper surface of the dividing wall 20. A lid 28 is positioned over the upper cavity 24 and mates with the upper edge of the side walls and end walls to enclose the upper cavity 24.

As shown in FIG. 12, an internal groove 30 is provided adjacent the upper peripheral edge of the end walls and side walls. A downwardly extending flange 32 mates with a groove to seat the lid in the upper cavity. The lid forms a cover for the upper cavity, thus providing a complete enclosure for the ignition coils.

Four spaced mounting apertures 36 are located in the dividing wall 20. These apertures are aligned with the mounting holes on an engine cylinder head for a conventional rocker arm cover. Conventional bolts (not shown) can be employed to secure the rocker arm cover 10 to the engine cylinder head.

Figure 1:
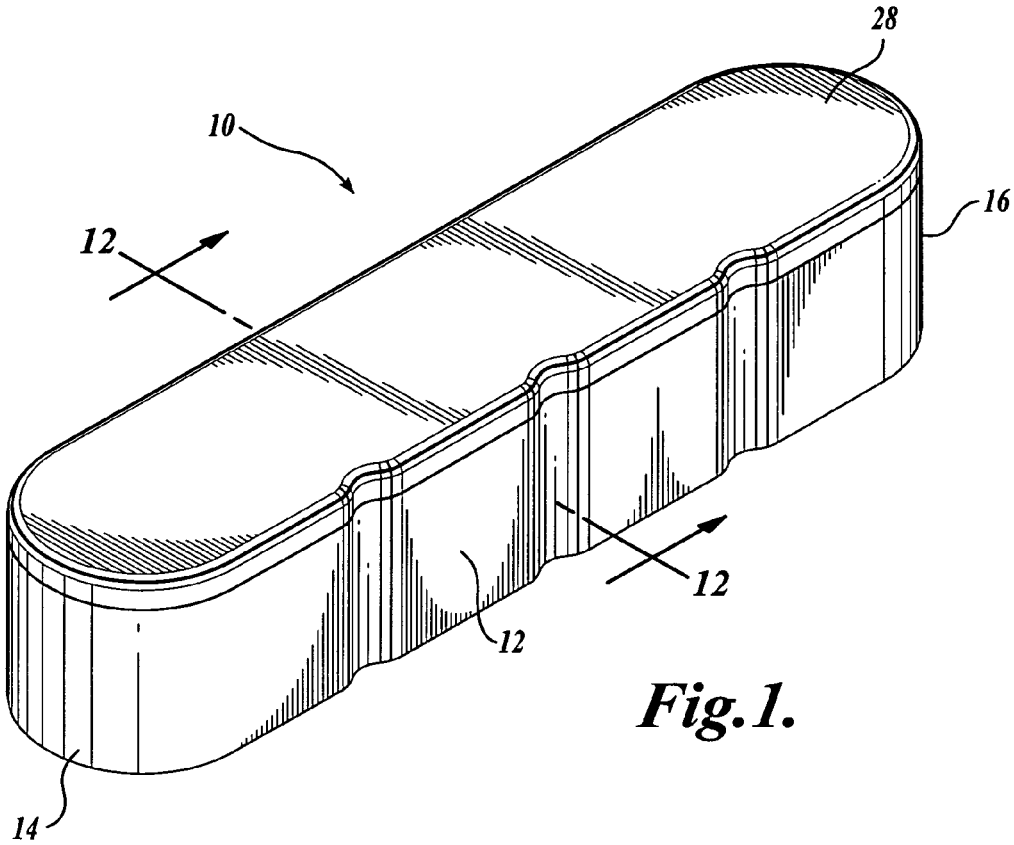
FIG. 1 is an isometric view of the rocker arm cover with the coil cavity lid in place.
Figure 2:
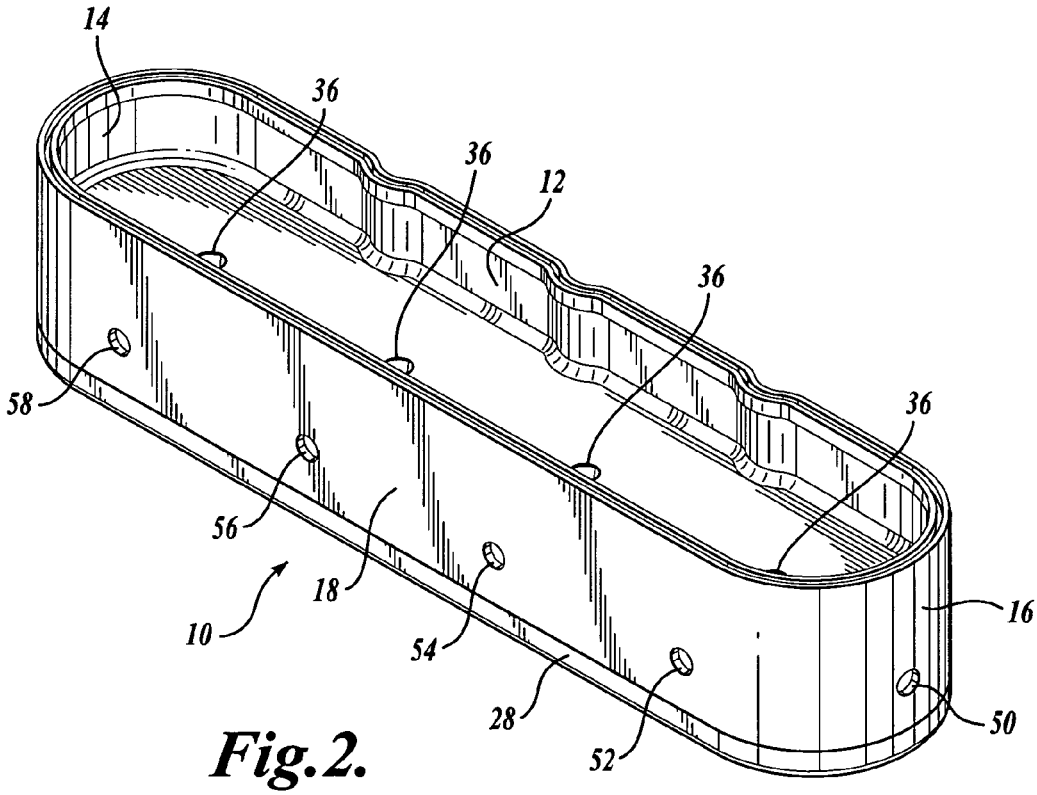
FIG. 2 is an isometric view of the rocker arm cover rotated 90 degrees about its vertical axis and 180 degrees about its horizontal axis from FIG. 1.
Figure 3:
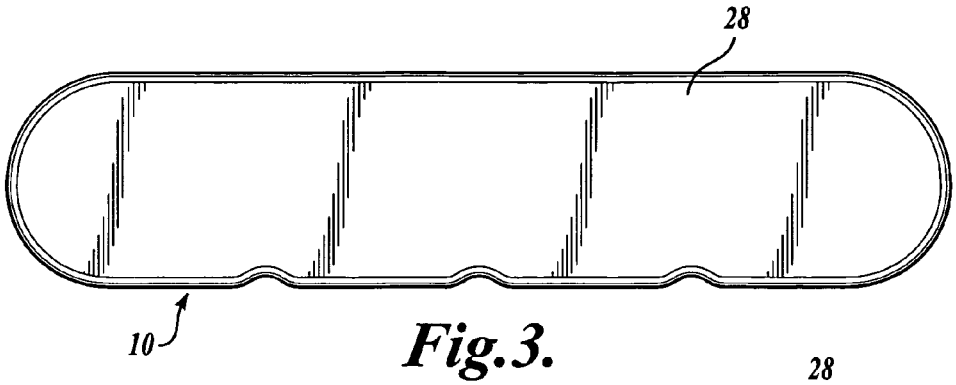
FIG. 3 is a top view of the rocker arm cover.
Figure 4:
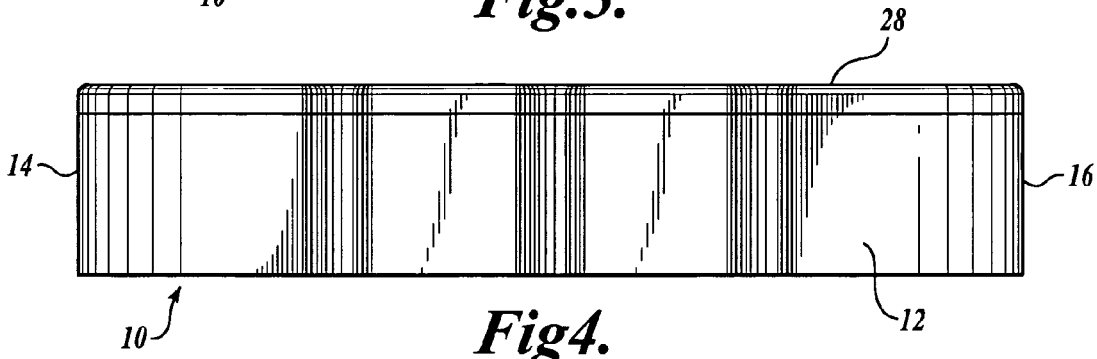
FIG. 4 is a front view of the rocker arm cover.
Figure 5:
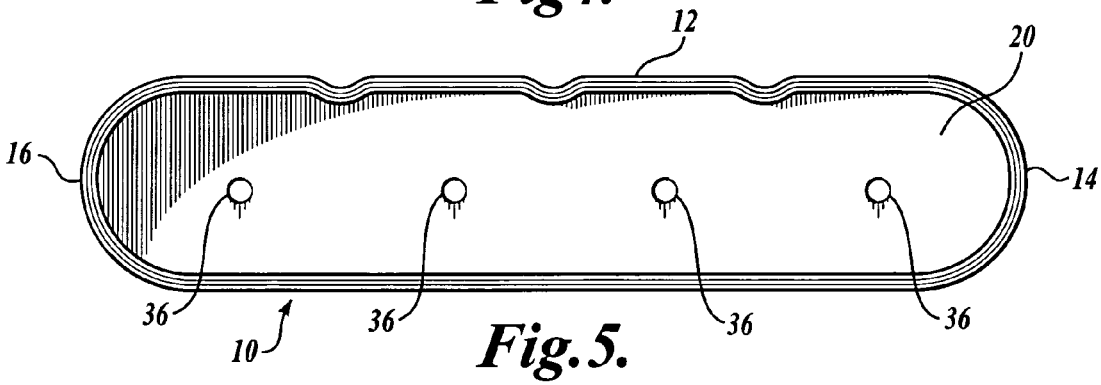
FIG. 5 is a bottom view of the rocker arm cover.
Figure 6:
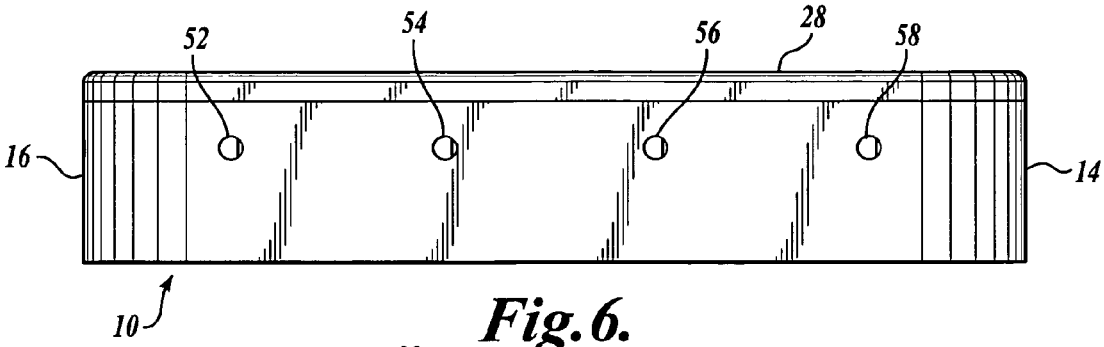
FIG. 6 is a rear view of the rocker arm cover.
Figure 7:
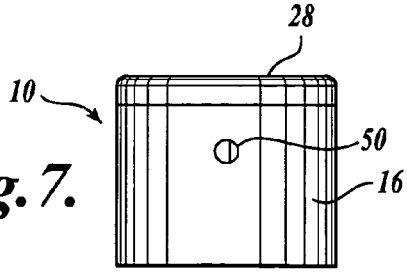
FIG. 7 is a view of one end of the rocker arm cover.
Figure 8:
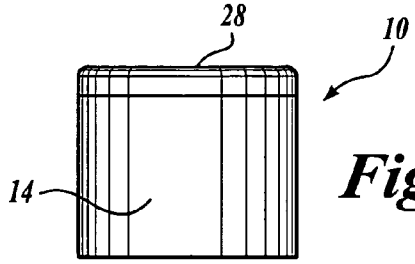
FIG. 8 is a view of the other end of the rocker arm cover.
Figure 9:
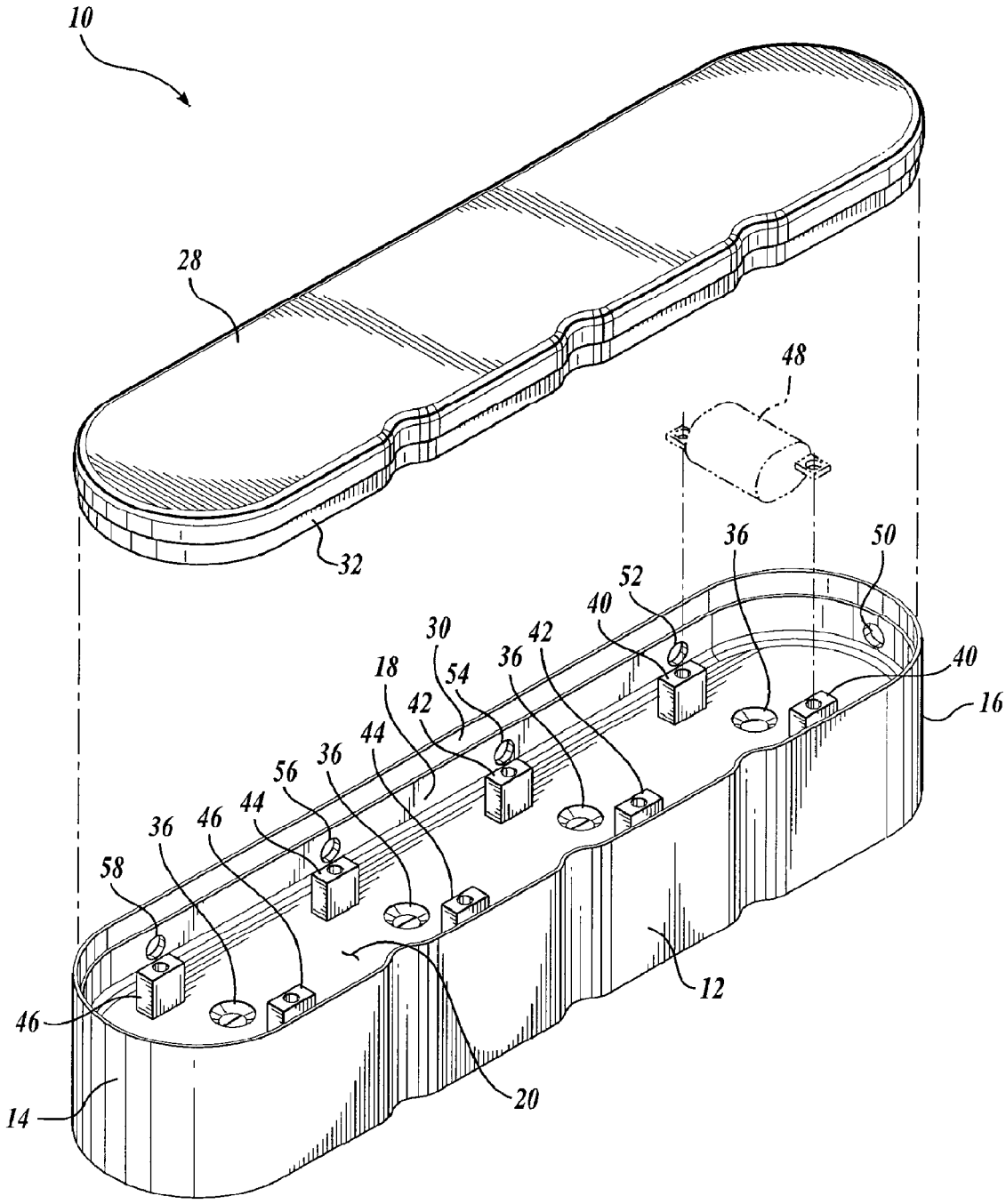
FIG. 9 is a view of the rocker arm cover showing the coil cavity lid removed.
Figure 10:
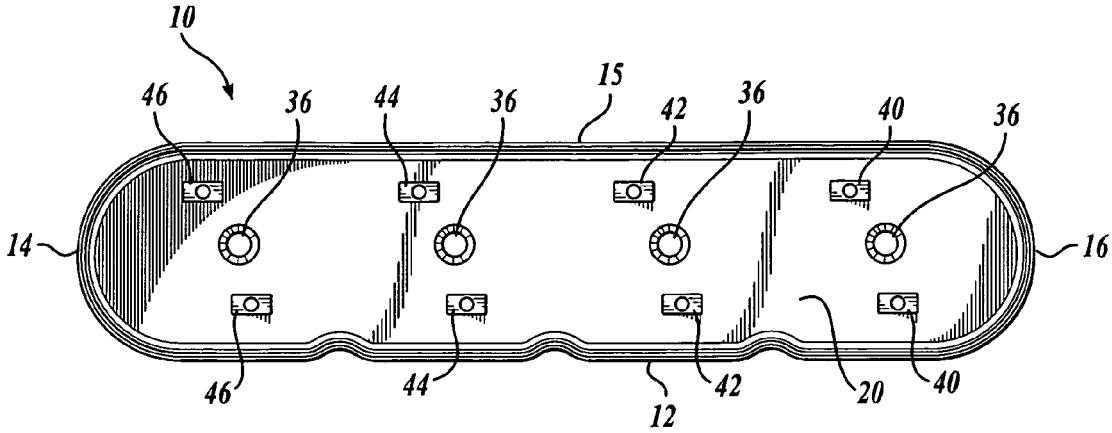
FIG. 10 is a top view of the coil cavity.
Figure 11:
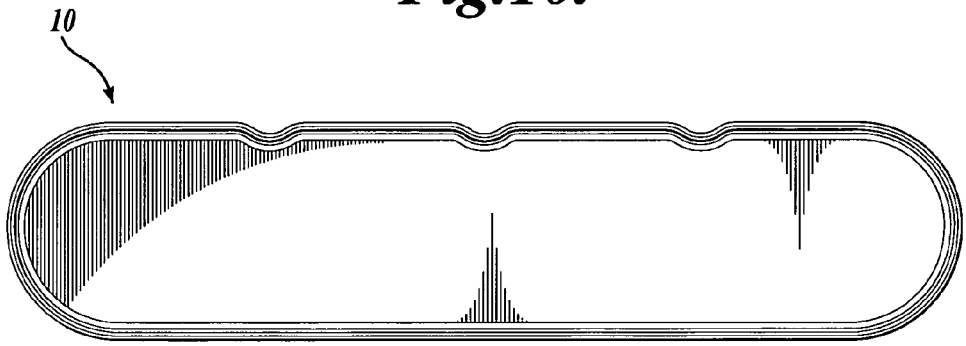
FIG. 11 is a bottom view of the coil cavity lid.

Referring to FIGS. 9, 10, and 12, four pairs of mounting lugs 40, 42, 44, and 46 are mounted on the upper surface of the dividing wall 20 and extend upwardly therefrom. Each of the mounting lugs carries a threaded aperture for receiving a bolt to match the flanges of an ignition coil to the lugs 40-46. One ignition coil 48 is shown in phantom positioned over mounting lugs 40. An input wire aperture 50 is provided in one of the end walls for input wires for the coils. Separate spark plug wire apertures 52, 54, 56, and 58 are positioned adjacent each set of mounting lugs in the outer wall 18 of the rocker arm cover.

Also as shown in FIG. 12, the bottom edges of the side and end walls carry a continuous upwardly extending groove 60. This groove is provided to receive a resilient gasket to seal against an engine cylinder head when the cover is fastened to the cylinder head.

It is to be understood that the preferred embodiment disclosed herein is specifically designed for V8 engines typical of those manufactured by General Motors Corporation for its performance vehicles. This style of rocker arm cover has the central mounting aperture 36 for mounting to the cylinder head. It is to be understood that the general concept of the rocker arm herein can be utilized with engines from other manufacturers and makes. Those rocker arm covers, however, may have a flange positioned around the bottom exterior portion of the rocker arm cover and provided with a plurality of fasteners to fasten the rocker arm cover to the cylinder head. It is understood that the particular configuration of the fastening means of the rocker arm cover to the cylinder head is not a part of this invention and that a variety of conventional fastening schemes as known in the art can be utilized with the rocker arm cover of the present invention.

While representative embodiments have been illustrated and described, it will be appreciated that various changes can be made therein without departing from the spirit and scope of the invention.

The embodiments of the invention in which an exclusive property or privilege is claimed are defined as follows:

1. A rocker arm cover assembly for covering only rocker arms of a bank of cylinders of an internal combustion engine comprising:

a) an elongated shell, generally H-shaped in cross section, said shell having:

i) an upper portion, ii) a lower portion, iii) a first, vertical, generally planar side wall having upper and lower margins, iv) a second, vertical, generally planar side wall having upper and lower margins, said second vertical planar side wall being spaced from said first vertical planar side wall, v) vertical end walls joined to the side walls and having upper an lower margins joining the upper and lower margins of said side walls, said end walls being generally semi-circular as seen in plan view, and defining in combination with said side walls a volume for enclosing rocker arms of said bank of cylinders, and vi) a horizontal dividing wall joining said first and said second vertical planar side walls and said vertical, semi-circular end walls, said horizontal dividing wall being disposed medially between the upper and lower margins of said side and end walls, the horizontal dividing wall and the portion of the side walls and end walls below said horizontal dividing wall defining a lower cavity for enclosing only said bank of rocker arms on an engine cylinder head, and the horizontal dividing wall and the upper portion of the side walls and end walls above said horizontal dividing wall defining a lower portion of an upper cavity for enclosing at least one high tension ignition coil;

b) a removable lid configured to matingly engage the upper marginal edges of said side and end walls to cover the lower portion of said ignition coil cavity, said lid and said lower portion of said upper cavity together defining said upper cavity for enclosing at least one high tension coil; and c) said first side wall having a plurality of spaced apertures therein, said apertures opening into said upper ignition coil cavity and being spaced above said horizontal dividing wall, said apertures being sized for spark plus wires to pass from said at least one high tension coil in said ignition coil cavity to plugs disposed external to said rocker arm cover assembly.

2. The rocker arm cover of claim 1, further comprising a coil input aperture in one of the side and/or end walls.

3. The rocker arm cover of claim 2, wherein said coil input wire aperture is in an end wall.

4. The rocker arm cover of claim 1, further comprising spaced coil mounting lugs affixed to the top surface of the dividing wall.

5. The rocker arm cover of claim 4, comprising four sets of coil mounting lugs spaced along and projecting upwardly from said horizontal dividing wall adjacent said side walls.

6. The rocker arm cover of claim 5, further comprising four spaced spark plug apertures in said outer wall, positioned respectively adjacent each of said four sets of coil mounting lugs.

7. The rocker arm cover of claim 6, further comprising a coil input wire aperture in one of said end walls.

* * * * *